United States Patent [19]

Krueger

[11] Patent Number: 4,636,765

[45] Date of Patent: Jan. 13, 1987

[54] FUSE WITH CORRUGATED FILAMENT

[75] Inventor: David J. Krueger, Arlington Heights, Ill.

[73] Assignee: Littelfuse, Inc., Des Plaines, Ill.

[21] Appl. No.: 705,901

[22] Filed: Mar. 1, 1985

[51] Int. Cl.[4] ..... H01H 85/38; H01H 85/04

[52] U.S. Cl. ..... 337/273; 337/158; 337/279

[58] Field of Search ..... 337/273, 279, 280, 281, 337/227, 228, 231, 232, 158, 159

[56] References Cited

U.S. PATENT DOCUMENTS

| | | | |
|---|---|---|---|
| 3,144,534 | 11/1964 | Baumbach | 337/166 |
| 3,374,328 | 3/1968 | Cameron | 337/279 |
| 4,048,610 | 9/1977 | Jacobs, Jr. | 337/273 |

*Primary Examiner*—Harold Broome

*Attorney, Agent, or Firm*—Russell E. Hattis

[57] ABSTRACT

A fuse (12) comprising a tube of insulating material having an inner (16) and an outer wall surface (18) and forming a fuse housing (14). The fuse includes a pair of conductive fuse terminals (24, 26) secured at opposite axial ends (20, 22) of the tube. A fuse element (23) is axially disposed within and extends between the ends of the fuse housing, and its ends are electrically and physically directly connected with the adjacent fuse terminal. A plug of initially solid, arc-quenching material (32) at preferably only at one end of the fuse housing occupies only a limited axial extent thereat and evaporates under fuse blowing conditions to fill the housing with an arc-quenching vapor.

9 Claims, 4 Drawing Figures

FUSE WITH CORRUGATED FILAMENT

DESCRIPTION

1. Technical Field

This invention has its most important application in tubular fuses of the type having a corrugated fuse wire connected directly between the opposite end caps of a tubular housing. As is the case with fuses in general, they are designed to break an electrical circuit after either a predetermined interval under a sustained modest overload, or immediately under a given high overload, i.e., short circuit, high energy arc-producing conditions.

The present invention relates to a unique means for quenching a potentially fuse-exploding arc within such fuses and which means enables fuses of very high current ratings to be reliably made less expensively and/or of smaller size. The development of fuse-exploding arcs is an especially difficult problem in fuses having corrugated fuse wires.

2. Description of the Prior Art

Tubular fuses for protecting electrical circuits are well-known and generally include a cylindrical insulating housing made, for example, of glass. The axial ends of the cylindrical housing are closed by a pair of generally cup-shaped end caps. A globule of molten solder is typically formed within the end cap just prior to its assembly with the housing. As the solder cools, it solidifies so as to secure the end caps to the outer wall surface at the ends of the housing. The solidified solder also supports both ends of a generally axially disposed fuse wire within the housing. This soldered connection also provides for electrical connection between the fuse wire and end caps so as to complete the circuit that the fuse is intended to protect.

In the event of a given sustained modest overload condition, or in the event of a sudden, high overload condition, the fuse wire will generally melt and break along an intermediate portion thereof, so as to permanently interrupt current flow through the protected circuit, unless a high energy arc develops across this break which re-strikes during each half cycle of an applied AC voltage. Upon formation of such a repeatedly sustained arc, the arc spreads outward toward both ends of the fuse, vaporizing an ever increasing length of the fuse wire. The pressure and temperature can build up within the fuse housing to a point which can cause the fuse housing to explode, unless the arc is quenched or the pressure is quickly dissipated in some manner. In general, this pressure is insignificant under modest overload conditions which blow the fuse, or even under short circuit conditions where, as is not uncommon in low amperage circuits, the resistance of the circuit conductors limits the build up of very high energy arcs because of the high voltage drop occurring along the circuit conductors under short circuit conditions. However, in electrical circuits normally carrying high rated currents, the circuit conductor resistance is of such low value that the more modest voltage drop occurring in the circuit conductors increases the voltage appearing across the fuse under short circuit conditions. This results in much higher energy short circuit current arcs which are much more difficult to quench by conventional means. The pressures and temperatures created by such a sustained high energy arc can be so substantial that the fuse will explode, causing a hazardous condition.

Because molten solder does not adhere closely and evenly to the walls of the glass of the fuse housing, the hardened solder does not provide a hermetic seal at the ends of the housing. Thus, in the absence of the addition of sealing materials to the ends of the fuse housing there are desirably present during modest prolonged overload conditions very small pressure relief spaces which generally avoid explosive pressure conditions when the fuse blows. However, in high current fuses under short circuit or other high overload conditions, the pressures resulting from a high energy arc which is not quickly quenched frequently will not be relieved sufficiently by the small spaces referred to between the solder and housing wall surfaces to avoid explosive pressures. Fuse manufacturers have generally compensated for these shortcomings of high amperage prior art fuses during sudden high overload conditions by increasing the housing wall strength by using special high strength or thicker housing walls, which increases the cost of the fuse.

Some prior art tubular fuses have included rigid, seal-forming bodies or plugs of arc-quenching or other materials on the inner sides of the solder joints at ends of the fuse housings thereof. Such a plug or body would normally be placed at both ends of a symmetrical tubular fuse of the type with which the present invention is primarily concerned. However, in U.S. Pat. No. 3,144,534, issued to Baumbach on Aug. 11, 1964, there is disclosed an unsymmetrical fuse where the fuse wire extends between an assembly of elements occupying at least one entire half of the fuse housing and the fuse end cap at the opposite end thereof. Adjacent to the latter end cap is placed a permanently solid plug of silicone, plastisol, or other arc-quenching material which fills a short portion of the fuse housing, to form an airtight arc-quenching insulation barrier thereat which physically quenches the arc by constricting the arc path thereat.

The assembly of elements of the Baumbach fuse referred to includes a relatively massive heat reservoir member surrounded by a heater coil. These components inhibit any potential arc movement to the opposite axial end of the fuse housing before the silicone plug quenches the arc. For this reason, the Baumbach fuse does not require a silicone plug adjacent both ends of the fuse housing, and so the Baumbach patent teaches the use of only a single arc-quenching plug in an unsymmetrical fuse of the type there involved, and so it does not apply to a symmetrical fuse where a silicone plug would appear to be required at both ends of the fuse, since it is not predictable whether a spreading arc will first reach one or the other end of the fuse housing.

The placement of such an arc-quenching plug at both ends of a fuse housing would be disadvantageous if they formed seals where the pressure and temperature conditions built up within the fuse housing could otherwise be relieved under prolonged modest overload conditions by the tiny pressure relief spaces at the end caps of the fuse as previously explained.

A symmetrical tubular Japanese fuse for low current circuits known to the applicant has a wax filling and sealing short lengths of the fuse housing on the inboard sides of unusually small quantities of solder at both axial ends of the fuse housing. It is believed that the wax-filled portions of this fuse are provided to assist in the mechnical retention of the fuse end caps, permitting a lesser amount of solder to be used. Thus, the amount of solder used in this fuse is merely enough to ensure good electrical contact between the end caps and the fuse wire, but is insufficient to ensure mechanical retention of the fuse end caps. There is no reason to believe that this wax used to retain the fuse end caps within this fuse housing has an arc-quenching function in the low current rated fuses involved since, as previously explained, low current rated fuses commonly do not present an arc-quenching problem.

Other prior art of interest discloses various means for quenching an arc. British Pat. No. 1,410,443, published on Oct. 15, 1975, to Pastors et al, is directed to an electrical fuse comprising a sealed casing, an arc-quenching liquid filler partially filling the fuse, and a body of capillary-porous material so arranged within the casing as to be at least partially immersed in the liquid filler. When the fusible element of the fuse melts due to the passage therethrough of a fuse blowing current, the capillary-porous body facilitates the extinction of the resultant arc.

Other prior art disclosures of general interest include Japanese Pat. No. 55-28175, dated July 25, 1980, which includes a fuse comprising an insulating tube filled with an arc-extinguishing agent.

Japanese Pat. No. 52-5699, dated Feb. 16, 1977, is an electrical fuse which comprises a low melting point gold-silicone alloy element wrapped around a tube in turn wrapped around a fuse wire. Upon blowing of the fuse, an arc-quenching gas is generated. The tube is made of a copolymer and is located at the mid-point of the fuse wire.

U.S. Pat. No. 3,143,615 is directed to a springless time-lag fuse for motor circuits that is filled with a pulverulent arc-quenching filler having a smaller heat conductivity than quartz sand.

U.S. Pat. No. 4,283,700 is directed to a fuse that includes an inner tubular member and an outer tubular member which is co-terminous with the inner tubular member. When a fuse-blowing overload current flows through this fuse and an electric arc is generated across its fusible element, the element will melt and generate metal vapors in the inner tubular member. The metal vapors and the heat generated in the inner tubular member cause fragmentation of the inner tubular member. Once the inner tube is fragmented, the electric arc and resulting metal vapors diffuse into the gaps or spaces between the broken and fragmented pieces thereof and the vapor is thus cooled. The outer tubular member is made of a material of high thermal impact resistance and so can withstand fragmentation under the aforementioned conditions so that the fragmented inner tubular member will be confined within the outer tube.

U.S. Pat. No. 4,417,226 is directed to a miniature fuse having a housing comprising a plastic base, a plastic cap, and two conductors which pass through the base and are bridged inside the cap by a fusible conductor. The interior of the fuse housing is lined with a ceramic-based lining to protect the plastic material of the base and cap against thermal decomposition and to promote condensation of the fusible conductor which is evaporated upon blowing of the fuse, to reduce internal pressure in the housing and avoid separation of the cap from the base and exposure of the conductive parts. Materials disclosed as suitable for the lining include paper or fibers processed into a web or ceramic powder such as aluminum (III) oxide, silicon dioxide, or magnesium oxide supported in a binder.

Other prior art will be hereafter described.

SUMMARY OF THE INVENTION

The most advantageous form of the invention uniquely uses in a symmetrical tubular fuse a body of solid, volatilizable, arc-quenching material filling a short section of the fuse housing preferably at only one end of the housing, the material volatizing at least under high current overload fuse blowing conditions to quickly quench the development of a high energy arc which could otherwise cause the fuse housing to explode. The arc-quenching material is placed preferably at only one end of the fuse housing, so that the pressure relief capabilities of the other end of the housing are not disturbed. When the material volatizes, it quickly fills the entire length of the housing with a vapor, to quickly quench any arcs which develop at any point therealong. The volatilizable arc-quenching material also preferably condenses with the vaporized fuse wire material on the fuse housing walls and acts as an insulator to greatly increase the resistance thereof so that a blown fuse has a higher insulating resistance. The invention has proven successful in miniature high current rated fuses where current waveforms having an RMS value as much as 10 KA of current were successfully interrupted.

As previously indicated, this invention has particular utility in fuses with a corrugated fuse wire where one or more arcs can form at one or more bends in the fuse wire. In a fuse having a corrugated filament, the cross-section of the fuse wire at the bend points cannot be precisely controlled or predicted. Accordingly, some of these bend points will be of a smaller cross-section than others, and as a result have a resistance larger than the cross-section of other points. The melting and breaking of the fuse wire will occur at the points of smaller cross-section. Because it is not readily ascertainable whether the points of smaller cross-section are adjacent a particular axial end of the fuse, in the absence of knowledge that the arc-quenching material vaporizes under fuse blowing conditions, one would expect that the material would be necessary at both ends, so that there can be no possibility that an arc could reach the metal at an adjacent but arc-quenching material-free end of the fuse. However, it is believed that the present material evaporates by heat generated by the arc before the arc reaches either end of the tube, regardless of where along the length of the fuse the arc originates. Thus, only one mass of arc-quenching material adjacent one end of the fuse is needed.

In U.S. Pat. No. 3,348,007, to Urani, a fuse is disclosed having an arc-quenching, volatilizable material covering the spaced wide metal coated terminal-forming portions of an apertured insulating strip placed in a cylindrical glass housing between the end caps thereof. A thin fuse wire is connected between the inner ends of the insulating strip terminals. It is not believed that the patent is relevant to a fuse like the present invention, where the fuse wire is suspended directly between the end caps. Thus, Urani teaches the use of only a very thin coating of arc-quenching material on portions of a fuse on opposite sides of the fuse wire. Such a coating placed on the end caps or on the end portions of a thin fuse wire like that used in the present invention would probably not be effective. There is thus no teaching here of either using a volatilizable plug of such material at both opposite ends of the fuse or at one of the ends thereof.

Further, there is no indication that the Urani arc-resistant material coats the glass housing of the fuse and breaks up the particles of the fuse wire material deposited thereat as in the present invention by increasing the insulation resistance of a blown fuse.

While the broad aspects of the invention do not so require, unlike the Japanese fuse referred to which uses a wax at both ends of the fuse for fuse cap retention purposes permitting the use of only small amounts of solder, the preferred form of the invention uses normal amounts of solder at each end of the fuse housing for fuse end cap retention and electrical contact purposes.

As previously indicated, the present invention produces explosion-proof fuses under even extremely high overload current conditions where more costly special or thicker than normal glass housings were heretofore thought necessary to provide an explosion-proof fuse.

The above-described and other features of the invention will become apparent upon making reference to the specification, drawings and claims.

BRIEF DESCRIPTION OF SEVERAL VIEWS OF DRAWINGS

DETAILED DESCRIPTION OF EXEMPLARY FORM OF INVENTION

Figure 1:
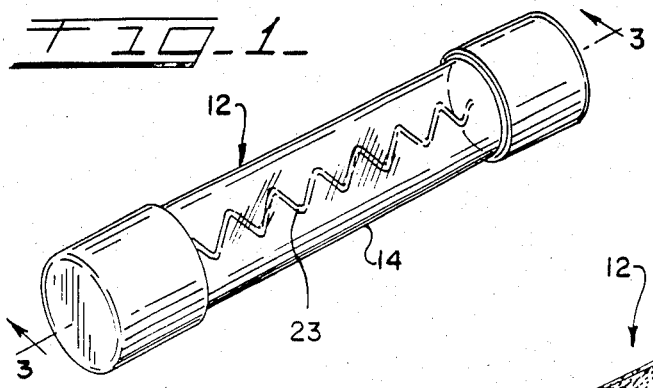
FIG. 1 is a perspective view of a preferred form of the fuse of the invention.
Figure 2:
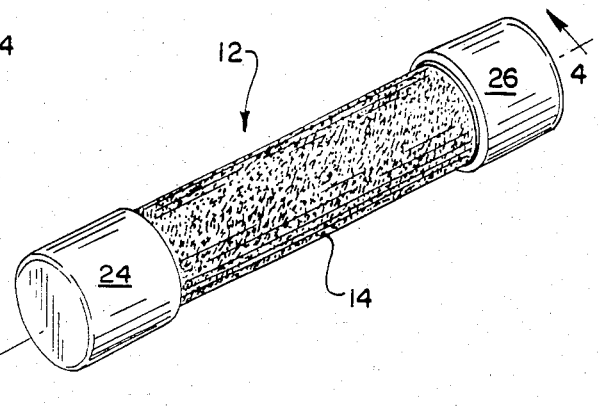
FIG. 2 is a perspective view of the fuse shown in FIG. 1 after the mass of solid, volatilizable, arc-quenching material and fuse element therein have evaporated.

Refer now to the fuse shown in FIGS. 1–4 and generally indicated by reference numeral 12. The fuse comprises a tube 14 of insulating material having an inner wall surface 16 and an outer wall surface 18 and two open ends 20 and 22. The tube is typically made of glass or other suitable insulating material and is commonly cylindrical. A pair of cup-shaped end caps 24 and 26 of an electrically conductive material are secured to the housing at its ends 20 and 22, respectively, to form a pair of fuse terminals.

The fuse 12 shown has a corrugated fuse element 23 that is generally axially disposed within the fuse housing and extends between the ends thereof where the fuse element ends are electrically connected with the end caps 24 and 26. Typically, this electrical connection will be facilitated by anchoring the disparate ends of the fuse element in a globule 28 of hardened solder adhered to each of the end caps 24 and 26. The amount of solder provided will be sufficient to ensure electrical contact between the fuse element 23 and the end caps and in this embodiment will also mechanically retain the end caps within the housing so that no auxiliary element retention means are required.

In one practical way to manufacture the present fuse, pellets of solder are first placed in each end cap oriented with its open end facing upwardly. Heat is then applied to the end cap to melt the pellet in the end cap. At a later point and time, when the end caps are to be assembled to the fuse housing, the end cap which is to ultimately include the arc-quenching material is oriented with its open end up, the end of the housing is dropped into the end cap and a pellet of a thermoplastic arc-quenching material which is to form the body of material 32 is placed loosely upon the then hardened solder. (As is conventional in the fuse art, the solder is of a type which initially comprises a core of resin material surrounded by a solder body.) One end of the fuse wire is dropped into the housing so it rests on the latter pellet. The end cap is heated to first melt the solder and then the arc-quenching material pellet. The fuse end and housing end sink into the melt and the housing and fuse end become securely anchored by the resin and solder to the end cap when the mix hardens upon cooling. The inverted and still open end of the housing is enclosed by another end cap which has a body of hardened solder therein. The latter end cap is then heated so that the solder-resin mix melts and secures the end cap to the housing when the mix cools.

The arc-quenching material 32 will generally seal the adjacent end of the fuse housing, but the other end of the housing which has no arc-quenching material is left unsealed to allow pressure relief under prolonged overload conditions to avoid destruction of the housing when the fuse blows under such conditions. The amount of solder-resin mix used at both ends of the fuse is sufficient to mechanically support the end caps to the housing without any auxiliary end cap retaining means.

Suitable arc-quenching materials include thermoplastic polyamide polymers and polymerized fatty acids and silicates such as those manufactured by the 3M Company, St. Paul, Minnesota, and sold as adhesives and available as stock nos. 3779 and XG-3793. Other suitable materials will include those having a volatilizing temperature in excess of the auto-ignition temperatures. Suitable polymers useful in the manufacture of the present fuses have softening temperatures of about 325° F., flame-induced flash points of about 550° F., and an auto-ignition temperature of about 900° F. These materials introduce insulating organic gases into the air within the fuse housing which increases the resistance of the arc to effect rapid quenching of the arc.

Figure 3:
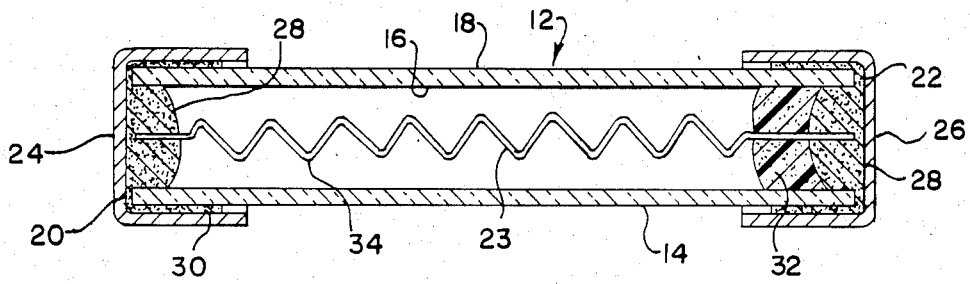
FIG. 3 is a longitudinal sectional view through the fuse of FIG. 1, taken substantially along the line 3—3 therein.
Figure 4:
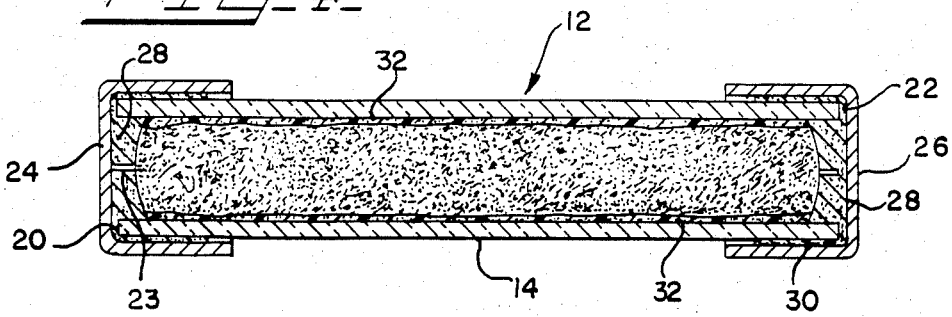
FIG. 4 is a longitudinal sectional view through the fuse of FIG. 2, taken substantially along the line 4—4 therein.

The operation of the fuse may be described as follows and by specific reference to FIGS. 3 and 4. As stated hereinabove, the fuse element 23 of the present invention is corrugated along its length; the particular fuse element shown at FIG. 3 is bent at eighteen (18) points between its disparate ends. For the purposes of this embodiment, it is assumed that the bent portions 34 of the fuse element have the smallest cross-section along the fuse element so that any arc commencing within the fuse during fuse blowing conditions is most likely to originate at one of the bent portions in the middle portion of the fuse element.

Under high current overload fuse blowing conditions, the present fuse will initially melt at one or more of the bent portions 34 in the middle region of the fuse element where a high energy arc is initiated and starts to spread outward vaporizing more of the fuse element as it expands. The resulting arc will cause a sudden increase in the temperature of the fuse interior, and the arc-quenching material, which has been chosen based upon the temperature likely to be attained within the particular fuse during arcing conditions, will vaporize. It is believed that the material undergoes a two-phase change from solid to gaseous form in a very short time interval which fills the entire housing with an arc-quenching vapor prior to the time the arc reaches either end 20 or end 22 of the fuse. Upon contact of the vaporized fuse element and vaporized, arc-quenching material with the relatively cold inner housing wall surface 16, these materials condense and harden, placing a thin coating of both materials along the inner wall surface 16 of the tube 14. The resulting coating imparts a reddish brown color to the fuse shown in FIGS. 2 and 4, an indication that the fuse has been blown by high overload current conditions, thereby giving the serviceman replacing the fuse an indication. Equally important, the condensed arc-quenching material portion of the coating separates a would-be continous thin coating of the fuse metal to ensure a high insulating resistance of the coating.

Upon the blowing of the fuse by a sustained but low current overload, the volatilizable material and most of the fuse element will not vaporize and the fuse housing remains substantially transparent or has a grey appearance from small particles of fuse wire material which sometimes coats the fuse housing. The slow pressure buildup in the fuse housing is limited by the pressure relief provided by the small pressure relief spaces 30 at the arc-quenching material-free end of the fuse housing.

The present fuse is operable at up to 250 volts and prevents explosion of a fuse at 10,000 amps under short circuit conditions. The invention has its primary utility in high current rated fuses, that is, fuses handling currents in excess of 3 amperes where fuse explosion hazards are present as previously explained.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while generally specific claimed details of the invention constitute important specific aspects of the invention, in appropriate cases the specific claims involved should be construed in the light of the Doctrine of Equivalents.

Thus, while a decidedly advantageous aspect of the invention is to use arc-quenching material only at one end of the fuse where it can be most conveniently and economically applied, it is within the scope of the broadest aspect of the invention to use an arc-quenching material which vaporizes under at least high overload conditions and spaced from an end of the fuse or to place the material at both ends where, because of the particular operating conditions of the fuse no pressure relief is needed to avoid explosion hazards and the loss of the cost savings by applying material to only one end of the fuse is acceptable to the manufacturer. Also, it is within the purview of the broadest aspect of the invention to use a permanently solid arc-quenching material sealing only at or near one end of a physically symmetrical fuse to assure the provision of pressure relief at the other fuse end where the fuse wire is specially designed to assure that the arc will never first reach the unsealed end of the fuse.

I claim:

1. A fuse comprising an outer tube of insulating material having an inner and an outer wall surface and forming a fuse housing, a pair of conductive fuse terminals at opposite axial ends of and secured to said tube, a meltable fuse element disposed within and extending substantially completely between the ends of said fuse housing, each fuse element end being eletrically and physically directly connected with the adjacent fuse terminal by solder or the like which does not form a seal at the end of the housing involved, and a body including a plug of initially solid, arc-quenching material in said housing which extends along and seals a limited axial extent of said housing to one side of the portion of the fuse wire where the fuse element is expected to blow, the other side of the housing interior remaining unsealed to serve a pressure relief function, said arc-quenching material evaporating under fuse blowing conditions to substantially fill the portions of the housing interior where an arc can develop with an arc-quenching vapor of such material.

2. The fuse of claim 1 wherein said body of arc-quenching material extends on and over the inner side of the solder or the like at one end of said housing.

3. A fuse comprising an outer tube of insulating material having an inner and an outer wall surface and forming a fuse housing, a pair of conductive fuse terminals at opposite axial ends of and secured to said tube, a meltable fuse element substantially disposed within and extending completely between the opposite ends of said fuse housing, each fuse element end being electrically connected with one of said fuse terminals through a body of solder or the like which secures the terminals to the housing ends and securely supports the fuse element ends in spaced relation to said inner wall surface, and a plug of initially solid arc-quenching material extending on and over the inner side of said body of solder or the like at least at one end of said fuse housing, said initially solid plug of arc-quenching material evaporating under fuse blowing conditions to substanitally fill the housing with an arc-quenching vapor of such material.

4. A fuse comprising an outer tube of insulating material having an inner and an outer wall surface and forming a fuse housing, a pair of conductive fuse terminals at opposite axial ends of and secured to said tube, a meltable fuse element disposed within and extending substantially completely between the ends of said fuse housing, each fuse element end being electrically and physically directly connected with the adjacent fuse terminal, and a housing end sealing plug of initially solid, arc-quenching material only at one end of said fuse housing, the other housing end being unsealed to serve a pressure release function, said arc-quenching material occupying only a limited axial extent of said one end of the housing and acting to quench an arc before the arc can reach the other end of said housing.

5. The fuse of claims, 1, 3, or 4 wherein said arc-quenching material is a thermoplastic organic material.

6. The fuse as set forth in claims 1, 3, or 4 wherein said fuse element is corrugated along its length to form bends of unpredictable cross-sectional areas where the fuse can blow and an arc formed at any one or more points therealong.

7. A fuse comprising an outer tube of insulating material having an inner and an outer wall surface and forming a fuse housing, a pair of conductive fuse terminals at opposite axial ends of and secured to said tube, a meltable fuse element disposed within said fuse housing and extending substantially completely between the end of said fuse housing, each fuse element end being electrically connected with one of said fuse terminals through a body of solder or the like which secures the terminals to the housing ends and securely supports the fuse element ends in spaced relation to said inner wall surface, and a plug of initially solid arc-quenching material at only one end of said fuse housing and extending over and abutting against said body of solder, said initially solid plug of arc-quenching material occupying only a limited axial extent of said one end of the housing and vaporizes under fuse blowing conditions to substantially fill the housing with an arc-quenching vapor of such material.

8. A fuse comprising an outer tube of insulating material having an inner and an outer wall surface and forming a fuse housing, a pair of condutive fuse terminals at opposite axial ends of and secured to said tube, a meltable fuse element disposed within said fuse housing, each fuse element end being electrically connected with one of said fuse terminals, said housing being free of any filler material so that the inner surface of said housing is fully exposed and over which inner surface the vaporized fuse element material of a blown fuse condenses and deposits a conductive coating, and a body of insulating material in said housing which material evaporated under fuse blowing conditions to substantially fill the housing with an insulating vapor which condenses with said vaporized fuse element material as a coating on the inner surface of said housing, so as to increase the leakage resistance of the coating after the fuse has blown.

9. The fuse of claim 8 wherein said insulating material is also an arc quenching material which quenches an arc developed when the fuse blows.

* * * * *